United States Patent [19]

Gartner

[11] Patent Number: 4,817,349

[45] Date of Patent: Apr. 4, 1989

[54] APPARATUS FOR HEATING, VENTILATING, COOLING AND REGULATING THE TEMPERATURE OF ROOMS OF A BUILDING

[75] Inventor: Karl Gartner, Gundelfingen, Fed. Rep. of Germany

[73] Assignee: Josef Gartner & Co., Fed. Rep. of Germany

[21] Appl. No.: 353,148

[22] Filed: Mar. 1, 1982

[30] Foreign Application Priority Data

Mar. 5, 1981 [DE] Fed. Rep. of Germany ..... 3108355

[51] Int. Cl.[4] ..... F24F 3/00

[52] U.S. Cl. ..... 52/220

[58] Field of Search ..... 52/173, 172, 171, 220, 52/235, 236.7, 236.9, 302, 303, 397, 79.12, 731, 730; 98/31, 40 C

[56] References Cited

U.S. PATENT DOCUMENTS

| | | | |
|---|---|---|---|
| 2,849,942 | 9/1958 | Goemann | 52/220 X |
| 3,128,852 | 4/1964 | Chell et al. | 52/731 |
| 3,415,024 | 12/1968 | Kotlarz | 52/220 X |
| 3,981,445 | 9/1976 | Custer | 98/31 X |
| 4,203,487 | 5/1980 | Gartner | 98/31 X |

FOREIGN PATENT DOCUMENTS

| | | | |
|---|---|---|---|
| 2020643 | 11/1971 | Fed. Rep. of Germany | 98/31 |
| 2817345 | 10/1979 | Fed. Rep. of Germany | 52/173 R |

*Primary Examiner*—John E. Murtagh
*Attorney, Agent, or Firm*—Jerome P. Bloom

[57] ABSTRACT

Apparatus for use in heating, ventilating, cooling and/or regulating the temperature of rooms in a building including a facade which comprises a framework of hollow posts and hollow girders is distinguished by sections of the hollow posts and hollow girders being connected to one another in flow, in fixed manner, for the conduction of a heat transfer fluid and an air stream between a delivery line and a return flow line. A distinguishing feature is that the hollow posts are constructed in two pieces or parts, each of which parts includes two channels one of which provides for the conduction of a heat transfer fluid and the other for the conduction of a further fluid such as an air stream. In the preferred form illustrated the post parts are made to be generally C-shaped in cross section. As thus provided the C-shape cross section of each part shows that it includes a double-walled base leg portion incorporating both the channel for the heat transfer fluid and a channel for further fluid. By virtue of the C-shape of the cross section of each part, two such parts, each of which exhibits freely projecting legs, are coupled through the medium of the legs along their length to define one hollow post. The two part construction of the post provides for connection of girders to each part in a manner that girders may tightly connected to the post in directly aligned pairs.

8 Claims, 6 Drawing Sheets

Figure 1:
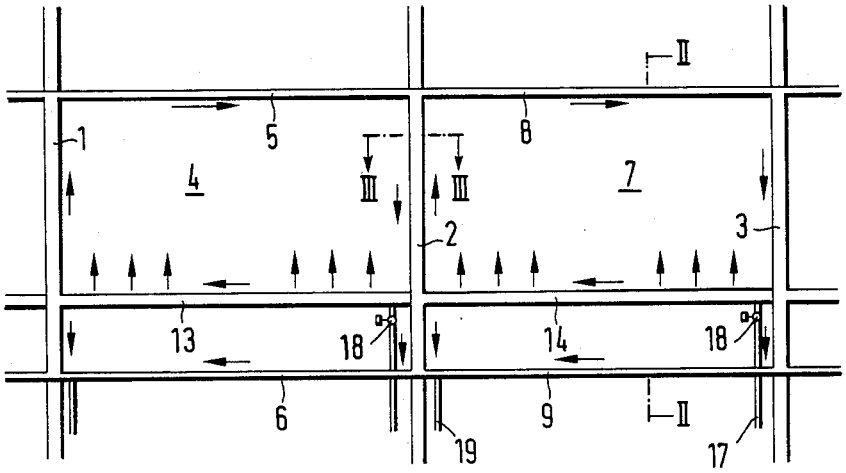

APPARATUS FOR HEATING, VENTILATING, COOLING AND REGULATING THE TEMPERATURE OF ROOMS OF A BUILDING

BACKGROUND OF THE INVENTION

This invention relates to improvements in apparatus for heating, ventilating, cooling and regulating the temperature of rooms of a building including a facade that comprises a framework of hollow posts and hollow girders, mounting facade elements and possibly window areas arranged to be substantially free of heat bridges, sections of which hollow posts and hollow girders in each room are connected with one another in flow, in a fixed manner to conduct a heat transfer fluid and an air stream between a forward flow line and a return flow line. A facade of the type described is known as an integrated facade which combines the normal function of the facade construction with the requirements of heating, ventilating, cooling and regulating the temperature of the rooms of the building of which it forms a part (German Published Application No. AS 26 21 186). The posts and transverse girders of the facade framework are executed from hollow profiles which serve as supporting construction for the reception of glazing and railing panels. By the inclusion of the facade posts and girders in the circulation portion of a hot-water heating or cooling system and with their simultaneous connection to a ventilating system per the present invention there is created a system superior in hygienic, technical and economic respects.

In a known system of the prior art the transversely disposed girders are joined with the hollow posts by welding. This form of execution is expensive and difficult to execute because of the requirement for exact connection of the channels for conduction of the heat transfer fluid and of the air stream. In another known system (German Unexamined Patent Specification OS No. 28 57 662) the hollow girders are joined with the hollow posts so as to be free of welding places. This particular system is disadvantageous in that the adjacent hollow girders cannot be mounted in alignment with one another on their common post. In this case the adjacent transverse girders must be connected to their common post so as to be offset against one another, either in a vertical or a horizontal direction. This is due to the fact the girder fastening elements to be applied must be accessible on the side of the post most remote from the particular transverse girder to be connected. When using this type of joining of posts and girders there arise problems in static and esthetic respects.

One possibility considered for connecting transverse girders to the posts so as to align with one another consists in arranging and mounting the girder in each case with only one end in connection with a post. This construction is disadvantageous, in the first place, because with a one-sided support of the girders on the posts there arises an untightness or deterioration of the support of girders at the location of their connection. In the second place this arrangement is disadvantageous because in its use there occurs an uneconomical water circulation and difficulties in and poorer regulation of the heating or cooling system provided.

Underlying the invention is the problem of forming the posts of the framework in such a way that the loads of their own weight, wind, vibration, etc., increasing as the spacing of the posts increases, can be absorbed without substantially increasing the amount of heat transfer fluid that must be conducted through the posts while simultaneously insuring a simple joining of posts and girders.

According to the invention, the solution of this problem is characterized by constructing the hollow posts in two pieces or parts, in each part of which is provided channels for the conduction of the heat transfer fluid and of the air stream required. Through the two piece execution of the posts it becomes possible to bring the transverse girders meeting the posts, at respectively opposite sides thereof, in alignment with one another. This is due to the fact that the post parts, before their joining, are each freely accessible for the fastening thereto of the respective transverse girder to be applied. Subsequent to the assembly of their parts, the resulting hollow posts present the cross section required for static reasons, which must be dimensioned in dependence on the weight of the construction, the traffic loads and the loads from wind, snow, vibration, etc. With the execution of the hollow posts according to the invention, the transverse girders of the framework of which the posts form a part can be connected at both ends to hollow posts in a manner that the tightness of their connections is insured.

In a preferred embodiment of the invention the post parts are constructed to be generally C-shaped. The shape and construction of the cross section of each post part provides it with a base leg and to or adjacent each of the respective ends of the base leg a freely projecting leg which is generally perpendicular thereto. The base leg has a double walled construction and embodies therein a channel for conducting a heat transfer fluid and a channel for conducting air. The two parts of each post which are C-shaped in cross section, are joined with one another along their free legs. Through this further development of the invention it is possible to provide for each of the hollow girders to be connected in each case to a channel for conducting heat transfer fluid and a separate channel for conducting an air stream. An important feature of the form of the cross section of the hollow posts so provided is that it yields a great moment of resistance and thereby provides, in its use, statically favorable values.

Advantageously the channel for the heat transfer fluid is arranged at one end of the base leg portion of each post part and the free cross section of the air conducting channel is made greater, by a multiple, than the free cross section of the channel for the heat transfer fluid. Through a provision that the cross section of the channels for the heat transfer fluid is small, the amount of heating or cooling fluid can be kept low in a system in accordance with the invention. This facilitates and provides for a rapid regulation and rapid heat transfer function of the heating or cooling fluid.

According to further features of the invention, the channels for conducting the heat transfer fluid are made circular in cross section and the air conducting channels are made substantially rectangular in cross section. With this arrangement, the base legs of the post parts in the region of the air conducting channels preferably are made to present corner recesses at the ends lying opposite the channels for the heat conveying fluid, for the installation, for example, of window frames.

According to a preferred embodiment of the invention the post parts are fabricated of aluminum.

The invention is described in detail in the following with the aid of examples of execution with reference to the drawing.

Figure 3:
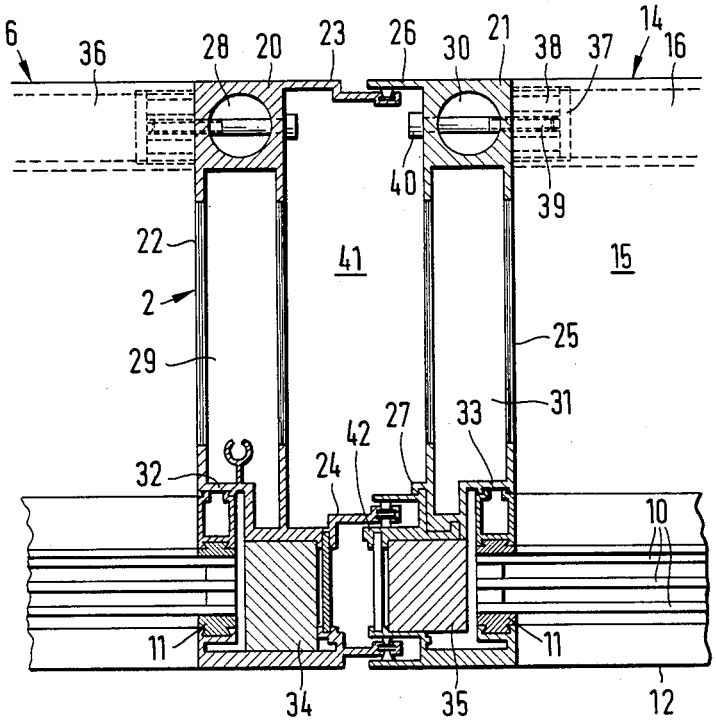
Figure 2:
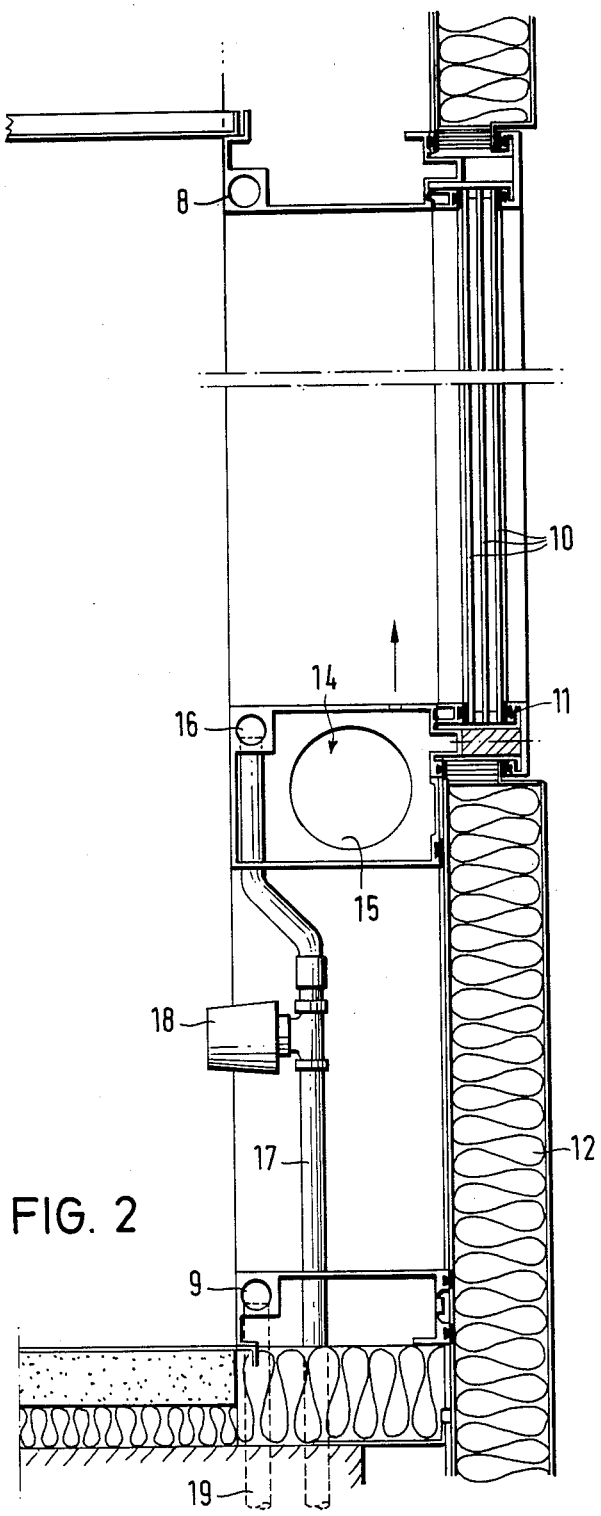
Figure 4:
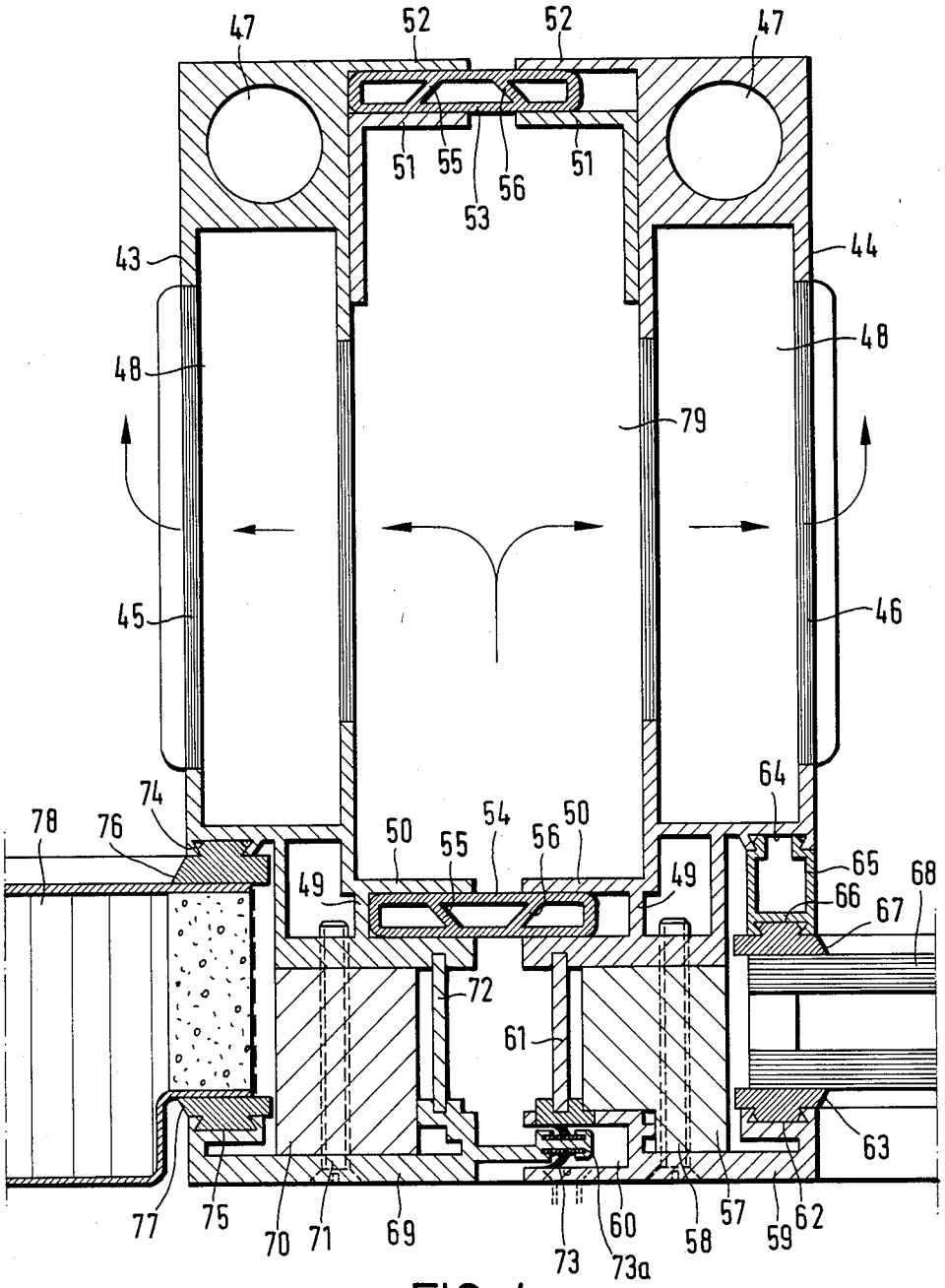

FIG. 1 shows schematically, in a front view, two adjacently arranged function fields of the facade of a house;

FIG. 2 an elevational section along the line II—II of FIG. 1;

FIG. 3 a section through a hollow post along the line III—III of FIG. 1;

FIG. 4 a section of a modified form of execution of a hollow post and

Figure 5:
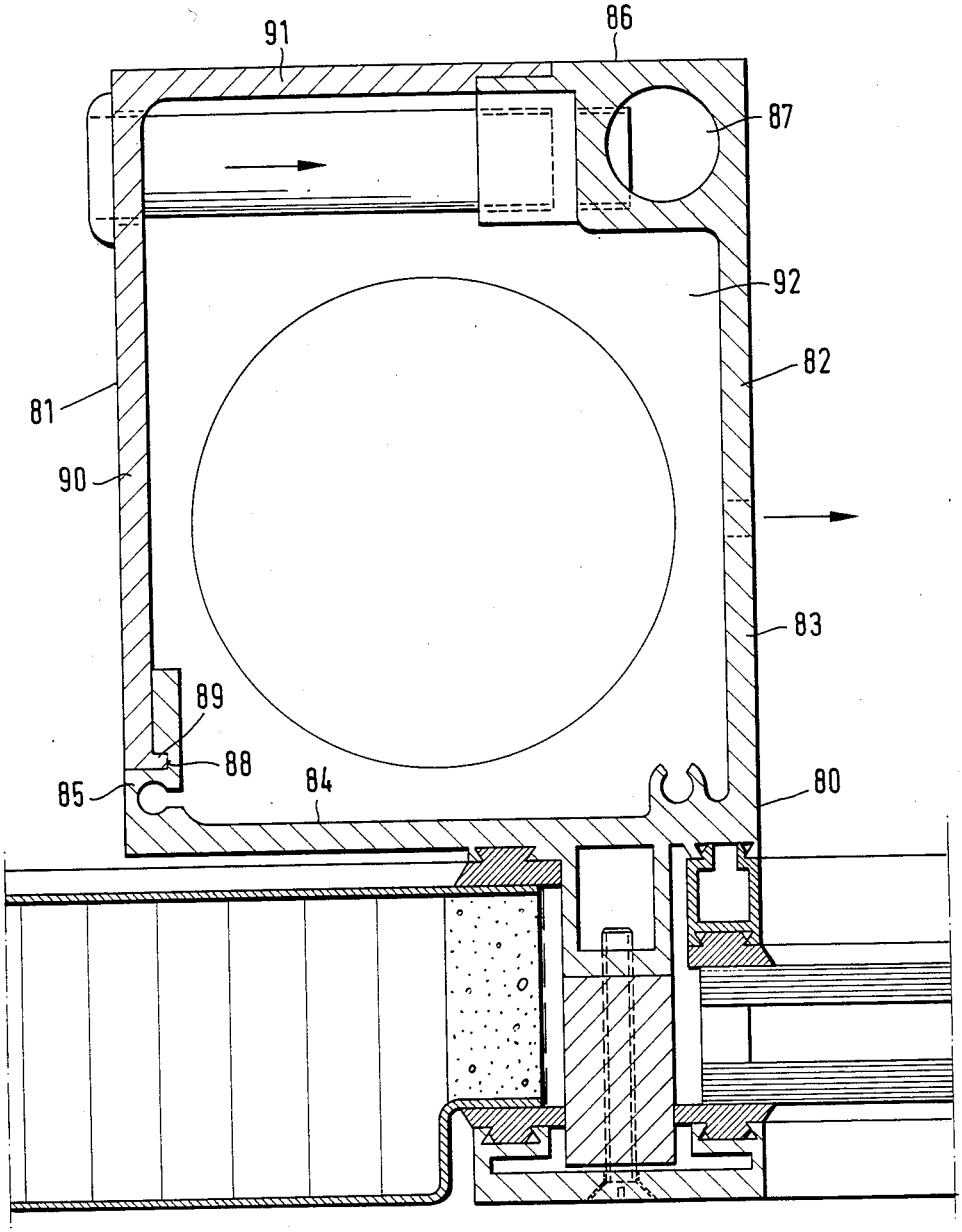

FIG. 5 a section through a railing girder.

The fields of a facade shown in FIG. 1 comprise hollow posts 1, 2 and 3 spaced from one another, between which there are arranged transversely running hollow girders. a first facade area 4 is bounded by the hollow posts 1 and 2 and hollow transverse girders 5 and 6. A second facade area 7 is formed by the hollow posts 2 and 3 and hollow transverse girders 8 and 9.

As is to be perceived from FIGS. 2 and 3, three hollow panes 10 are held on each facade area by means of insulating profiles 11, substantially free of heat and cold bridges, on the hollow posts and between railing plates 12. In the zone of the upper end of the railing plates there are arranged horizontal railing girders 13 and 14, in which there are provided air channels 15 and a channel 16 for the heat-conveying fluid.

At the end of the facade area 7 the channel 16 is connected to a delivery line 17, in which there is arranged a regulating valve 18. By way of the channel 16 in the railing girder 14, the hollow post 2, the transverse girder 8, the hollow post 3 and the transverse girder 9 there is established a connection to a return flow line 19. The water input to the function field by way of the delivery line 17 for heating or cooling the air fed into the airfeed channel 14 flows in the channel or tube 16 into the hollow post 2 and passes from there by way of the transverse girders 8 and 9 and the hollow post 3 to the return flow line 19.

As may be perceived from FIG. 3, the hollow posts, in the example shown, the hollow post 2, are constructed in two parts. The two post parts 20 and 21 each present in cross section a substantially C-shaped form. The post part 20 is comprised of a double-walled base leg 22 and free legs 23 and 24; the post part 21 is comprised of a double-walled base leg 25 and free legs 26 and 27. In the base leg 22 there is formed a channel 28 for the heat transfer fluid which is round in cross section and a substantially rectangular channel 29 for the air stream. Corresponding channels 30 and 31 are present in the base leg 25 of the post part 21. The air conveying channels 29, 31 are provided at their outer ends with corner recesses 32 and 33. These recesses serve for the installation of the insulating profiles of the window panes or the installation of window frames. At the outer free legs 24 and 27 of the post parts there are provided sealing profiles 34, 35, which are arranged on the post parts 20, 21 in such a way that they cannot form any heat bridges.

The air conveying channel 31 presents in the zone of the railing girder 14 an opening through which there is created a connection of the air channel 15 to the air conducting channel 31. Corresponding connections are formed in the other hollow posts.

The transverse girders are connected free of welding places to the channels 28, 30 for the heat transfer fluid. FIG. 3 shows the connection of the tube 16 running in the railing girder 14 to the channel 30 and a tube 36 running in the lower transverse girder 6 to the channel 28. Into the end of the tube 16 provided with an inside thread there is screwed a sleeve 37 with an outside thread. The sleeve 37 presents axially directed passage openings 38 for the passage of the heat transfer fluid and an axially directed central bore 39 which is threaded. The base leg 25 is provided on its outer side with a bore which leads into the fluid channel 30. The sleeve 37 extending from the tube 16 is guided through this bore into the channel 30.

A screw bolt 40, which runs perpendicular to and through the base leg 25 and the passage 30, and into the bore 39, is threadedly engaged thereby to the sleeve 37. The sleeve 37 is connected, in turn, with the tube 16. The connection so provided braces the post part 21 with the tube 16. For the purpose of a fluid proof tube connection there are provided sealing washers between the connecting parts. The connection of the channel 28 with the tube 36 is similarly executed. Since the channels 28 and 30 are accessible independently of one another from the interior of the parts of the hollow post 2, tubes can be connected to the post in alignment with one another at the same height.

In a space 41 enclosed by the post parts 20 and 21, for example, lines can be provided or it can likewise be drawn upon for the air conduction. The connection of the free legs 23, 26 and 24, 27 can be accomplished, by screwing, riveting or by profile parts 42.

FIG. 4 shows in cross section a modified form of a hollow post according to the invention, which is composed of post parts 43 and 44. The post parts are identical in cross section, the post part 43 being rotated with respect to the post part 44 through 180° about the horizontal. This measure contributes to the economy of the system. Double-walled base legs 45 and 46 present channels 47 for the heat-transfer fluid and channels 48 for the air conduction. At the ends of the double-walled base legs opposite channels 47 there are molded double-walled legs 50 at a right angle, joined by a fillet 49. Through right angled profiles 51 applied to the inside of the base legs, on a side of its channel 47 in each case, the free legs 52 are likewise made double-walled. The legs 50 and 52 of the post parts 43 and 44 with their openings lying opposite receive in each case a common sealing band 53 and 54, respectively. The sealing bands 53 and 54 have a substantially rectangular open cross section including reinforcements 55 and 56 presenting an oppositely running bevel.

On the post part 44, over an elastic spacer piece 57, by means of a screw 58, there is mounted a profile strip 59, which is provided with a longitudinal groove 60 on the end directed toward the post part 43. Between this end of the profile strip 59 and the outer wall of the leg 50 of the post part 44 there is provided a spacer 61. At the other end of the profile 59 there is molded on a swallow-tail-shaped groove 62, in which there runs a sealing band 63. At the outer end of the base leg 46 there is provided a swallow-tail-shaped groove 64, in which there is held a double-walled spacing or compensating piece 65 by a snap connection. This compensating piece 65 presents on its back a swallow-tail groove 66, in which there is held a sealing band 67. Between the sealing bands 63 and 67 there is held a double-walled windowpane 68 of insulating glass.

To the double-walled free leg 50 of the post part 43 there is connected a profile strip 69 over an elastic spacing piece 70 by screws 71, a fixed spacer 72 presenting a sort of pivot point for the profile strip 69. On the end facing the post part 44 the profile strip presents a spring extending into the longitudinal groove 60 of the profile strip 59, which spring is provided with sealing lips 73*a*.

Between the profile strip 69 and the base leg 45 of the post 43 there is enclosed between sealing bands 76 and 77 held in swallow-tail grooves 74 and 75 the edge of a facade panel 78. The air conduction channels 48 present, for example, at the height of a railing girder, (not represented) openings for the conduction of the air stream. The space 79 closed off by the sealing bands 53 and 54 between the post parts 43 and 44 can be drawn altogether for the guidance of the air stream, whereby its flow amount can be increased. Through the connection of the post parts 43 and 44 over the sealing bands 53 and 54 and the sealed-off tongue-and-groove connection 60, 73 the hollow post fulfills the function of an expansion joint post.

FIG. 5 shows a cross section through a railing girder 80, which is composed of parts 81 and 82. The girder part 82 consists, in cross section, of two whole legs 83 and 84 integrally connected to dispose at right angles to each other. Molded integrally with the projected extremity of the leg 83, along the length thereof, is a perpendicularly projected leg section 86. Molded integrally with the projected extremity of the leg 84, along the length thereof, is a generally perpendicularly projected leg section 85. In the corner formed by the leg 83 and the leg section 86 there is provided, along the length thereof, a channel 87 for conducting heat transfer fluid, the wall of which is circular in cross section. In an inwardly shifted projected end portion of the leg section 85, the length thereof, there is provided a groove 88 into which there engages the complementarily shaped end 89 of the leg 90 of the girder part 81. The leg 91 of the girder part 81 which is integral with and perpendicular to the leg 90 extends to lie with its projected extremity, along the length thereof, in a complementarily shaped offset portion of the outermost surface of the leg portion 86. The space 92 defined by the hollow post structure of FIG. 5, the wall structure of which is generally rectangular in cross section, serves for the connection through the post of air. The post of FIG. 5 is shown to exhibit, in connection therewith, a pipe-like adapter through which a heat transfer fluid may be delivered to the channel 87.

As seen in FIG. 5, there are arranged on the railing girder there illustrated, opposite the channel 87, a window and a facade panel. The execution corresponds substantially to the type and is in a manner set forth in the case of the showing of FIG. 4. In this case the leg 83 of the girder is provided with air exhaust slits.

Obviously, it is possible to provide only one post part 20, 21 or 43 alone as a supporting part of a facade framework which simultaneously conducts heat transfer fluid and air to provide circulation in a system facilitating an improved heating, ventilating, cooling and regulating of the temperature of the rooms of the building of which the integrated facade in accordance with the invention forms a part.

Accordingly, it may be seen that with the improvements of the invention one enables an integrated facade wherein the framework consists of hollow posts and hollow girders and the hollow posts are constructed in two pieces each of which in forming part of a post is provided with a channel for conducting heat transfer fluid therethrough and a channel for conducting an air stream. Not only does the construction of the hollow post here provided afford eminently satisfactory load carrying capacity and strength in use but by virtue of its two part construction it is enabled not only that the transversely disposing hollow girders of the framework on the same level are kept in alignment with one another but also that adjacent of the girders are enabled to be directly aligned and to both be connected, free of welding places, so the channel in each thereof for conveying heat transfer fluid is tightly communicated with a channel for conveying heat transfer fluid in the post part to which it end abuts in its connection thereto.

Fundamentally, in any case, the invention provides a new, improved and highly utilitarian construction for a hollow post for a facade which is useful, as and when required, to circulate fluid as part of a circulation system.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for use in heating, ventilating, cooling and/or regulating the temperature of rooms in a building including a facade which comprises a building support structure in the form of a framework of hollow posts and hollow girders, to which there are applied facade elements and possibly window areas substantially free of heat bridges, characterized in that sections of said hollow posts and hollow girders are connected to one another in a fixed manner for the conduction through at least a portion thereof of a heat transfer fluid, between delivery and return flow lines, a further fluid in heat exchanging relation to said heat transfer fluid, said hollow posts being load carrying structural support members constructed in two pieces, each of said two pieces constituting a post part which is an integral structure and at least one thereof being formed to provide within the body thereof at least two channels, respectively for conduction of the heat transfer fluid and for the conduction of said further fluid, said post parts being interconnected to define therebetween a utility passage and being respectively adapted for the independent connection thereto of hollow girders to have the girders interconnect therewith in one or more aligned pairs, without welding, for the movement thereto and/or therefrom of said fluids, said two post parts being generally C-shaped in cross section and each including a double-walled base leg portion, incorporating a channel for said heat transfer fluid and a channel for said further fluid, which has relatively freely projecting legs which are perpendicular thereto through the medium of which said two post parts are coupled to define therebetween a third channel which provides said utility passage and one said hollow post.

2. Apparatus according to claim 1 characterized in that the free cross section of the channel conducting said further fluid in said base leg portion of said post parts is greater by a multiple than the free cross section of the channel for conducting heat transfer fluid.

3. Apparatus for use in heating, ventilating, cooling and/or regulating the temperature of rooms in a building including a facade which comprises a building support structure in the form of a framework of hollow posts and hollow girders, to which there are applied facade elements and possibly window areas substantially free of heat bridges, characterized in that sections of said hollow posts and hollow girders are connected to one another in a fixed manner for the conduction through at least a portion thereof of a heat transfer fluid, between delivery and return flow lines, a further fluid in heat exchanging relation to said heat transfer fluid, said hollow posts being load carrying structural support members constructed in two pieces, each of said two pieces constituting a post part which is an integral structure and at least one thereof being formed to provide within the body thereof at least two channels, respectively for conduction of the heat transfer fluid and for the conduction of said further fluid, said post parts being interconnected to define therebetween a utility passage and being respectively adapted for the independent connection thereto of hollow girders to have the girders interconnect therewith in one or more aligned pairs, without welding, for the movement thereto and/or therefrom of said fluids, said two post parts including a double-walled base leg portion incorporating said channels within the body thereof and said base leg portions having, along the lateral limits thereof, freely projecting legs which are perpendicular thereto through which the said two post parts are coupled to define one said hollow post and said base leg portion of each of said post parts presenting in a zone thereof remote from that of the channel for heat transfer fluid a corner recess at its exterior facilitating the installation, for example, of window frames.

4. A structural member for use in erecting the framework of a building and to form part of a system for heating, ventilating, cooling and/or regulating the temperature of rooms in such building comprising two longitudinally extending elements each of which is integrally formed, said elements being joined together along their length to define a single post or girder and form therebetween a longitudinally extending passage accommodating utility lines and/or the flow therethrough of fluid, each said element incorporating therein, along its length, at least two side by side channels each of which is constructed and arranged to conduct a fluid and to provide that such fluids are in a heat exchanging relation, each said element of said post being formed in cross section to have a generally C-shaped configuration providing it with a base portion and to one side of said base portion freely projecting legs by means of which said elements are coupled to define said passage between said base portions thereof, said base portion being formed to embody therein two said channels, one said channel for carrying therethrough a heat transfer fluid and the other said channel carrying therethrough a second fluid in heat exchanging relation thereto.

5. Apparatus according to claim 4 characterized in that the channel for carrying air has a cross section the dimension of which is greater, by a multiple, than the free cross section of the channel for conveying a heat transfer fluid.

6. Apparatus according to claim 4 characterized in that the channel for carrying heat transfer fluid is circular in cross section and the channel for carrying an air stream is substantially rectangular in cross section.

7. A building including load carrying post serving as structural support members forming part of the framework of the building and functioning in the heating, ventilating, cooling and/or regulation of the temperature of rooms in such building, at least a portion of said posts comprising a longitudinally extended load bearing unit comprised of two elements each shaped in cross section to include a base leg portion and, projected from one face thereof and substantially perpendicular thereto, leg means by means of which said two elements are coupled to provide a pair of like said elements defining therebetween a longitudinally extended fluid flow passage providing for an elective application therein of a flow of air or utility lines for said building, said base leg portion having a longitudinally directed fluid flow channel provided in the body thereof which is bounded peripherally by an integrally formed wall structure a portion of which contains therein a further longitudinally directed flow channel for a second fluid, providing thereby that fluids may be passed through said channels in a heat exchanging relation to one another.

8. A building as in claim 7 characterized in that a facade structure is interconnected with said wall structure at one side thereof and an opposite side portion of said wall structure contains said flow channel for a heat exchange fluid.

* * * * *

UNITED STATES PATENT AND TRADEMARK OFFICE

CERTIFICATE OF CORRECTION

PATENT NO. : 4,817,349

DATED : April 4, 1989

INVENTOR(S) : Karl Gartner

It is certified that error appears in the above-identified patent and that said Letters Patent is hereby corrected as shown below:

Col. 5, line 43, correct "connection" to read -- conduction --.

Col. 8, line 25, (claim 7, line 1) correct "post" to read -- posts --.

Signed and Sealed this

Tenth Day of October, 1989

*Attest:*

DONALD J. QUIGG

*Attesting Officer*

*Commissioner of Patents and Trademarks*